United States Patent [19]

Chappatte

[11] 4,081,950

[45] Apr. 4, 1978

[54] CALENDAR MECHANISM FOR TIMEPIECE

[75] Inventor: Jean-Maurice Chappatte, Neuchatel, Switzerland

[73] Assignee: Ebauches S.A., Neuchatel, Switzerland

[21] Appl. No.: 664,883

[22] Filed: Mar. 8, 1976

[30] Foreign Application Priority Data

Mar. 18, 1975 Switzerland ..... 3405/75

[51] Int. Cl.[2] ..... G04B 19/24; G09D 3/08

[52] U.S. Cl. ..... 58/4 R; 40/113; 58/5; 58/58

[58] Field of Search ..... 58/4 R, 5, 58; 40/107, 40/111, 113, 118

[56] References Cited

U.S. PATENT DOCUMENTS

| | | | |
|---|---|---|---|
| 3,696,606 | 10/1972 | Scholz | 58/58 |
| 3,818,692 | 6/1974 | Zaugg et al. | 58/58 |
| 4,048,795 | 9/1977 | Risi | 58/4 R |

FOREIGN PATENT DOCUMENTS

| | | | |
|---|---|---|---|
| 1,927,243 | 12/1970 | Germany | 58/58 |

*Primary Examiner*—Stanley J. Witkowski

*Attorney, Agent, or Firm*—St. Onge, Mayers, Steward & Reens

[57] ABSTRACT

A calendar mechanism for a timepiece having indicators for the day of the month and for the day of the week, in which the indicators are held in each position by a locking lever pivotally mounted for movement between operative and inoperative position with respect to the indicators. The locking lever has two integral arms, one cooperating with each of the indicators for locking and releasing them. The driving member which indexes the indicators once every twenty-four hours is provided with means for urging the locking lever into its operative position at all times except when the indicators are being indexed to new positions, so that the indicators remain in place when they are not being driven but can be independently reset at any time.

4 Claims, 2 Drawing Figures

CALENDAR MECHANISM FOR TIMEPIECE

BACKGROUND OF THE INVENTION

The present invention relates to a calendar mechanism for timepieces having indicators for the day of the month and of the week which are arranged to move simultaneously step-by-step at the rate of one step each twenty-four hours, under the action of a rotatable driving member making one revolution per twenty-four hours. The invention relates more particularly to a locking device for preventing accidental movement of the indicators from the position to which they are moved by the driving member at the end of each day.

SUMMARY OF THE INVENTION

The locking device of the present invention includes a locking lever, pivotally mounted for reciprocal movement between operative and inoperative positions, the locking lever having two arms for simultaneously restraining the two indicators when the lever is in its operative position. One of the arms cooperates with the driving teeth of a first of the indicators and the other with the driving teeth of the second indicator for restraining them when the locking lever is in its operative position, the arms being disengaged from the teeth for releasing the indicators when the locking lever is in its inoperative position. The member which indexes the indicators by driving them one step at a time and the locking lever are provided with means, such as a cam on the drive member and a resilient arm on the locking lever which engages the cam, for urging the locking lever into its operative position and then for releasing it so that it can move to its inoperative position while the indicators are being indexed.

DETAILED DESCRIPTION OF PREFERRED EMBODIMENT

Figure 1:
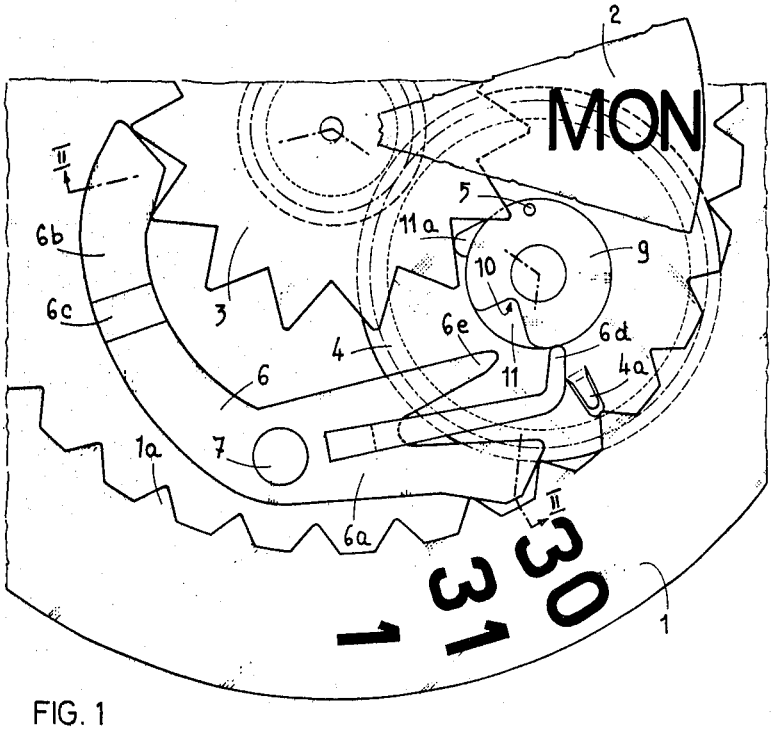

The drawing shows by way of example one embodiment of the invention.

Figure 2:
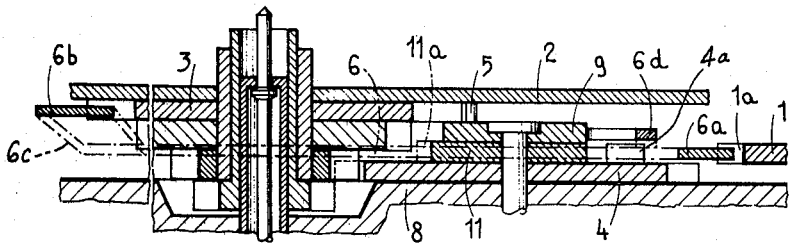

FIG. 1 is a plan view of a part of a calendar mechanism incorporating the invention, and FIG. 2 is a sectional view along line II—II of FIG. 1.

As illustrated in FIGS. 1 and 2, the calendar mechanism includes a crown ring 1 for indicating the days of the month, crown 1 having inner teeth 1*a* by which it is driven. A disk-indicator 2 for the days of the week is rigidly mounted on a star-wheel 3 by which it is driven. Both indicators 1 and 2 are driven step-by-step at the rate of one step each twenty-four hours by a sprocket wheel 4, which makes one revolution per twenty-four hours and which is itself driven by the clockwork of the timepiece on which the calendar mechanism is mounted. Wheel 4 is provided with an upwardly extending tongue 4*a*, which engages teeth 1*a* once every revolution for indexing indicator 1 once a day. Wheel 4 is also provided with a pin 5 which engages star-wheel 3 once each revolution for displacing it by one tooth at the same time that the indicator 1 is being displaced one tooth by tongue 4*a*.

The two indicators 1 and 2 are also subjected to the action of a locking device which ensures the stability of their position when they are not driven. The locking device consists of a two-arm lever 6 which is articulated at 7 on the frame 8 of the mechanism, the two arms of lever 6 being designated by 6*a* and 6*b*. When locking lever 6 occupies its operative or working position as represented in the drawing, the end of its arm 6*a* engages and locks teeth 1*a* of the dates indicator 1, while the end of its arm 6*b* engages the star-wheel 3 for locking the days indicator 2. Since the two indicators are not situated in the same plane, the arm 6*b* is provided with a bent portion 6*c* so that its end is located in the plane of the wheel 3, while the rest of the lever 6 is situated in the plane of the crown ring 1.

Rigidly mounted on the driving wheel 4 is a circular cam 9, against which bears a resilient arm 6*d*. It will be noted that the pin 5 is mounted on cam 9 for driving engagement with star-wheel 3 as tongue 4*a* drives crown-ring 1. Arm 6*d* is mounted on and forms part of lever 6, which in this instance is made of a plastic material, the resilient arm 6*d* extending out of the plane of the rest of the lever 6 so that it is situated in the plane of the cam 9. Consequently cam 9 acts on the lever 6 through the intermediary of the resilient arm 6*d*, thereby resiliently holding the lever in its working position. In this working or operative position of the locking lever, a small restraining torque is applied to the clockwork which is released only once each revolution as a recess 10 in the cam 9 moves counter-clockwise from the position shown in FIG. 1, so that arm 6*d* enters it at the moment when the tongue 4*a* and the pin 5 operate the indicators 1 and 2, respectively. At this moment, the action of the teeth 1*a* on the end of the arm 6*a*, on the one hand, and of the teeth of the star-wheel 3 on the end of the arm 6*b*, on the other hand, brings the lever 6 into an inoperative position by rotation of the lever in a counter-clockwise direction.

Since the cam 9 and wheel 4 rotate together at a rate of one revolution every twenty-four hours, it would not be suitable—in spite of the fact that it is possible—to use the escape edge of the recess 10 to bring the lever 6 back into its working position. This is due to the fact that arm 6*d* must be disposed substantially radial to cam 9, and therefore the escape edge of recess 10 is necessarily inclined such that it would take several hours to return the lever 6 to its working position, during which time the two indicators 1 and 2 would remain unlocked. Consequently, a second cam 11, which is likewise rigid with wheel 4, is interposed between the wheel 4 and the cam 9 in the plane of the locking lever 6. Cam 11 has a lobe 11*a* which acts on a finger 6*e* of locking lever 6 for pivoting the level in a clockwise direction. As soon as the two indicators have been indexed to the next position, the nose 11*a* of the cam 11 acts on the finger 6*e* of the lever 6 and moves it back into its working position.

Owing to the elasticity of the arm 6*d* of the locking lever 6, the two indicators 1 and 2 are resiliently locked so that if the mechanism is subjected to a shock, the indicators are held in place. Moreover, where the locking mechanism of the present invention is used on a timepiece provided with a manually operable correcting device for the calendar indicators which acts directly on the indicators without passing through the intermediary for the driving wheel 4, the locking lever 6 operates like a jumper and is returned to its working position by its resilient arm 6*d* when the indicators 1 and 2 are driven by this correcting device.

It is to be noted that the calendar mechanism as disclosed and represented is of the so-called dragging type, its indicators being driven at the same speed at which the driving wheel 4 rotates. However, the invention could also be applied to a calendar mechanism of the so called "instantaneous" type, in which step-by-step displacements of the indicators are effected instantaneously at 24 hour intervals.

What I claim is:

1. In a calendar mechanism for a timepiece having a clockwork, a first indicator for the day of the month and a second indicator for the day of the week, a driving member rotatable by said clockwork for indexing said indicators at the rate of one revolution for every twenty-four hours, each of said indicators having teeth by which they are simultaneously driven step-by-step by said driving member at the rate of one step for each twenty-four hours, a locking device for said indicators comprising a locking lever articulated on the frame of the timepiece for reciprocal movement between operative and inoperative positions and having two integral arms for simultaneously restraining said indicators against movement when in such operative position, one of said arms cooperating with the teeth of said first indicator and the other of said arms cooperating with the teeth of said second indicator for restraining movement of said indicators when said locking lever is in its operative position, said arms being disengaged from said teeth when said locking lever is in its inoperative position, thereby releasing said indicators, said driving member and locking lever having means for urging said locking lever into its operative position and for releasing said locking lever so that it can move to its inoperative position while said indicators are being indexed.

2. A locking device as defined in claim 1, wherein said means for urging said locking lever into its operative position is rigid with said driving member.

3. A locking device as defined in claim 1, means for urging said locking lever comprises a circular cam on said driving member and a resilient arm on said locking lever which bears against said cam and resiliently maintains said locking lever in its operative position, said cam being provided with a recess for receiving said resilient arm when said locking lever occupies its inoperative position in order to release said indicators for movement by said driving member.

4. A locking device as defined in claim 3, which further includes a second cam rigid with said first-named cam and having a lobe engageable with said locking lever for moving it rapidly back into its operative position.

* * * * *